US006394311B2

(12) United States Patent
McCann et al.

(10) Patent No.: US 6,394,311 B2
(45) **Date of Patent: *May 28, 2002**

(54) CARBONATED AND NON-CARBONATED WATER SOURCE AND WATER PRESSURE BOOSTER

(75) Inventors: Gerald P. McCann, Los Angeles; Donald Verley, Lake Elizabeth, both of CA (US)

(73) Assignee: McCann's Engineering & Mfg. Co., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/800,452

(22) Filed: Mar. 6, 2001

Related U.S. Application Data

(63) Continuation of application No. 09/253,182, filed on Feb. 19, 1999, now Pat. No. 6,196,418.

(51) Int. Cl.[7] ..... B67D 5/56

(52) U.S. Cl. ..... 222/61; 222/64; 222/129.1; 261/DIG. 7

(58) Field of Search ..... 222/61, 64, 129.1, 222/129.2, 129.3, 129.4, 399; 261/DIG. 7

(56) References Cited

U.S. PATENT DOCUMENTS

| | | | | |
|---|---|---|---|---|
| 3,248,098 | A | 4/1966 | Cornelius | 261/115 |
| 4,306,667 | A | 12/1981 | Sedam et al. | 222/83.5 |
| 4,631,375 | A | 12/1986 | McCann | 200/84 |
| 4,764,315 | A | 8/1988 | Brusa | 261/140.1 |
| 4,886,525 | A | 12/1989 | Hoover | 55/55 |
| 4,917,831 | A | 4/1990 | Ziesel et al. | 261/27 |
| 4,928,854 | A | 5/1990 | McCann et al. | 222/129.1 |
| 4,986,447 | A | 1/1991 | McCann et al. | 222/129.1 |
| 5,033,645 | A | 7/1991 | Shannon et al. | 222/61 |
| 5,033,646 | A | 7/1991 | McCann et al. | 222/69 |
| 5,085,810 | A | 2/1992 | Burrows | 261/104.1 |
| 5,097,863 | A | 3/1992 | McCann et al. | 137/504 |
| 5,139,708 | A | 8/1992 | Scott | 261/23.1 |
| 5,411,179 | A | 5/1995 | Oyler et al. | 222/129.1 |
| 5,417,146 | A | 5/1995 | Zimmer et al. | 99/323.1 |
| 5,538,160 | A | 7/1996 | Ziesel | 222/1 |
| 5,553,746 | A | 9/1996 | Jones | 222/129.1 |
| 5,568,882 | A | 10/1996 | Takacs | 222/61 |
| 5,743,433 | A | 4/1998 | Hawkins et al. | 222/64 |
| 5,855,296 | A | 1/1999 | McCann et al. | 222/61 |
| 6,036,053 | A | 3/2000 | Simmons et al. | 222/64 |
| 6,196,418 | B1 * | 3/2001 | McCann et al. | 222/61 |

FOREIGN PATENT DOCUMENTS

| | | |
|---|---|---|
| EP | 322-729 A | 12/1988 |
| WO | WO 90/02702 | 3/1990 |

* cited by examiner

*Primary Examiner*—Joseph A. Kaufman
(74) *Attorney, Agent, or Firm*—Lyon & Lyon LLP

(57) ABSTRACT

Disclosed is a water pressure booster apparatus which can be employed for the dispensing of beverages. The booster can be combined as a carbonator and water pressure booster apparatus for holding both carbonated and non-carbonated water at elevated pressures, for the dispensing of carbonated and non-carbonated beverages. The apparatus has a tank including a tank chamber with a booster chamber therein. The two chambers are separated by a flexible membrane such that the elevated pressure is essentially the same in the two chambers. The booster chamber is removable through an access port in the tank. A valve provides inlet water to the tank chamber and the booster chamber. The location of the membrane controls the valve between charging of the two chambers. The valve is a spool valve with one end coupled to the membrane. The quantities of water in the two chambers controls activation of a pump which provides charging water to the chambers.

10 Claims, 7 Drawing Sheets

CARBONATED AND NON-CARBONATED WATER SOURCE AND WATER PRESSURE BOOSTER

This is a continuation application of U.S. patent application No. 09/253,182, filed Feb. 19, 1999, issued as U.S. Pat. No. 6,196,418 on Mar. 6, 2001, the disclosure of which is incorporated herein by reference.

BACKGROUND OF THE INVENTION

The field of the present invention relates to apparatus for boosting water pressure and/or for use in carbonated and/or non-carbonated beverage dispensers and beverage vending machines.

Carbonation devices, generally referred to as carbonators, used in conjunction with carbonated beverage dispensers and/or vending machines, for example, are well-known. FIG. 1 shows a typical prior art carbonator 10. It includes means for supplying both fresh non-carbonated water 16 and carbonating gas, such as $CO_2$, at a regulated pressure to a carbonator tank 12 where the two are mixed to form carbonated water 30. It also includes a conduit for transporting carbonated water 30 from the carbonator tank 12 to a post-mix dispensing nozzle 42 of a post-mix tower and dispenser assembly 40, where the carbonated water 30 is mixed in suitable proportions with a quantity of flavor concentrate or syrup 34 from a supply source 32 to produce the composite carbonated drink.

The carbonator 10 also normally includes some type of water pump 18 to supply and replenish non-carbonated water 16 from a water supply 14 at an elevated pressure to the carbonator tank 12 which also receives $CO_2$ at elevated pressures from a source 24. Both mechanical and electrical pump configurations have been utilized. The pump 18 (and a motor 20, in case of electrical configurations) is generally controlled by means of a level control 28 which senses the amount of carbonated water in the carbonator tank 12. Thus, when a volume of carbonated water 30 is dispensed from the carbonator tank 12, it is replaced by a fresh volume of pressurized non-carbonated water 22.

With the increased popularity of non-carbonated beverages such as tea, orange drink or lemon-lime, there is a greater need for post-mix tower and beverage dispenser assemblies that are equipped to provide both carbonated and non-carbonated beverages. Consequently, the prior art apparatus of FIG. 1 includes a conduit for transporting non-carbonated water 16 (which is generally at a lower pressure) from a water supply 14 to a post-mix non-carbonated beverage dispensing nozzle 49, where non-carbonated water 16 is mixed with a suitable quantity of flavor concentrate or syrup 46 from a source 44 to make the desired non-carbonated beverage. The water supply 14 for making the non-carbonated beverage may be the same supply as that utilized in the carbonator tank 12 for making carbonated water 30.

The mixing of the beverage syrup or concentrate (34 or 46) and carbonated water 30 or non-carbonated water 16 needs to be properly proportioned or "ratioed." Depending on the desired end beverage, a precise ratio of water and syrup is mixed in order that the ultimate taste of the end beverage not be compromised. For example, if too little water or too much syrup are mixed, the end beverage would be too sweet for consumption.

In the case of making a carbonated beverage, because the carbonator tank 12 holds the carbonated water at an elevated and uniform pressure that is nearly independent of any fluctuations in pressure of the water supply 14, the proper ratios in mixing of the carbonated water 30 and the syrup 34 are not significantly compromised by any pressure fluctuations in the water supply 14. However, if the non-carbonated water 16 is drawn from a typical water source 14 (e.g., tap water), the ratio of non-carbonated water 16 to syrup 46 will be affected by the variations or fluctuations that typically occur in the pressure of such a water supply 14. These pressure fluctuations may have numerous causes, including the use of water in other parts of the premises from which water is drawn, such as water fountains, sinks, showers, and toilets.

As non-carbonated beverages have garnered a greater share of the beverage market, there have been efforts to find a solution to the detrimental effects of water pressure fluctuations on the proper ratio of non-carbonated water 16 and syrup or concentrate 46. One such effort to minimize the effect of pressure fluctuations in the water supply 14 is depicted in FIG. 2. There, the carbonation and post-mix beverage dispensing system of FIG. 1 is modified to include a separate means for pressurizing non-carbonated water 16 drawn from the source 14 and storing it in a separate water booster tank 50 for making the non-carbonated drink. The tank 50 is usually made of cold-rolled steel and includes an internal plastic liner or special coating to prevent rusting and/or the emission of metallic or other undesirable tastes. The tank 50 incorporates a flexible membrane 51 such as a thick rubber diaphragm or bladder that is locked in place, dividing tank 50 into two sides. The membrane 51 is installed before the tank 50 is closed, after which the tank 50 is fully welded and sealed. Therefore, if the membrane 51 should fail, the tank 50 is usually completely discarded since there is no way to effect replacement of the membrane 51, other than by cutting the tank 50 open and attempting to reweld and reseal it.

One side of the tank 50 is generally pre-charged with air to 30 psi at the tank manufacturer's location, however, additional pressure can be added by the customer up to as high as 100 psi. There is generally a tire valve stem 55 on one end of the tank 50 to introduce the air pressure, with the opposite end having an inlet for plain water 56 to be admitted and stored. To overcome the pressure on the opposite (air) side of the membrane 51, a pump and motor must be utilized. Water 16 from the supply 14 may, for example, be pumped to the desired elevated pressure by a pump 52 and a motor 54, and then supplied to the tank 50. As water 56 enters the water side of the tank 50, the membrane 51 expands into the air side of the tank 50, raising the pressure therein. When the air pressure is increased to the desired amount, a pressure switch 60 will stop the motor 54 and the pump 52. Non-carbonated water 58 at the desired elevated pressure can then be drawn from the tank 50 on demand for mixing with syrup 46 from the syrup supply 44. A properly mixed non-carbonated beverage is then available at a designated post-mix dispensing nozzle or faucet 49.

The apparatus of FIG. 2, however, suffers certain deficiencies. Even with the separate water booster tank 50, dispensing non-carbonated drinks can be problematic because water boosters generally do not exceed 100 psi and normally operate between 60 and 80 psi, while soda water carbonators pressures normally run from 100 to 150 psi. Accordingly, the proportions or rates of syrup flow for carbonated versus non-carbonated drinks need to be set differently. Further, the float controls may need to be sized differently in the non-carbonated faucets than in the carbonated faucets, resulting in increased equipment costs and installation costs because of the extra parts, special spouts, diffusers and faucets. Moreover, the pressures of the carbonated versus non-carbonated water supplies are independent of each other, introducing further difficulties in trying to maintain the proper mixing ratios of water to syrup.

Further complicating matters, because the majority of drinks sold through most beverage dispensers are carbonated, dispenser faucets are usually equipped with diffusers that create a pressure drop to slow the soda water down as it pours into the cup, thereby preventing foaming. But, because the non-carbonated water pressure is generally already lower than that of the carbonated water, the further reduction in pressure created by these diffusers can cause the non-carbonated water to flow too slowly and/or in insufficient quantity.

A further problem posed by the independent water booster is that some customers like beverages dispensed with reduced carbonation. To achieve this, they may try to blend plain water in a 1:1 ratio with soda water in the faucet. The pressure differential between the carbonated and non-carbonated water supplies, however, may determine the actual ratio of carbonated to non-carbonated water, preventing the desired blending.

Moreover, from the standpoint of cost and space requirements, providing separate means of pressurizing and storing non-carbonated water for preparation of non-carbonated beverages is unsatisfactory. As seen in FIG. 2, the modified post-mix tower and dispenser assembly requires two pressure vessels (or tanks) 12 and 50, possibly two pumps 18 and 52, two motors 20 and 54, a liquid level control 28 set for making carbonated beverages, and a pressure switch 60 set for making non-carbonated beverages. Aside from space requirements (which in the beverage dispenser and vending machine industry is an important concern), this solution entails nearly double the costs of manufacturing, installing and servicing.

In short, the pressurization and pumping equipment required for the non-carbonated water for making non-carbonated beverages in conventional post-mix beverage dispensers and/or vending machines can result in a relatively large, bulky, heavy and costly system which is ill-suited for utilization in low-volume, cost-driven, limited space environments, and still may not produce reliable results. Additionally, the need for cleaning, repairing and replacing such devices can prove to be a burden as well.

SUMMARY OF THE INVENTION

The present invention is directed to a booster for water pressure. One application for such a booster is as a non-carbonated water source. It may be combined with a carbonated water source as well. A tank is divided by a flexible membrane. One chamber is for a compressible fluid while the other may contain a body of water at substantially the same pressure.

In a first separate aspect of the present invention, a combined carbonated and non-carbonated water source for a beverage dispenser includes a tank with a chamber and an access port. A booster chamber extending into the tank is formed from a flexible membrane and a closure element. The closure element is positionable in sealing engagement with the access port. The booster chamber has a first configuration allowing insertion and withdrawal from the tank chamber.

In a second separate aspect of the present invention, a conbined carbonated and non-carbonated water source for a beverage dispenser includes a tank with a chamber and an access port. The tank includes an inlet and a source of pressurized carbonating gas. A booster chamber extending into the tank also includes an inlet and is formed from a flexible membrane and a closure element. The closure element is positionable in sealing engagement with the access port. A source of pressurized water extends to a valve assembly which is in communication with the inlet to the tank and the inlet to the booster chamber to provide communication between the source of pressurized water and alternatively the tank inlet and the booster chamber inlet.

In a third separate aspect of the present invention, a combined carbonated and non-carbonated water source for a beverage dispenser includes a tank with a chamber and an access port. A booster chamber extends into the tank and has a flexible membrane. A source of pressurized water extends to a valve assembly which is in communication with an inlet to the tank and an inlet to the booster chamber. The valve assembly provides communication between the source of pressurized water and alternatively the tank inlet and the booster chamber inlet. The valve assembly is operatively coupled with the membrane to control communication through the valve assembly.

In a fourth separate aspect of the present invention, a combined carbonated and non-carbonated water source for a beverage dispenser includes a tank with a chamber and a source of pressurized carbonating gas. A booster chamber extends into the tank and has a flexible membrane. A source of pressurized water extends to a valve assembly in communication with an inlet to the tank and an inlet to the booster chamber. The valve assembly provides communication between the source of pressurized water and alternatively the tank inlet and the booster chamber inlet. The valve assembly is operatively coupled with the membrane to control communication through the valve assembly. A liquid level sensor switch is in the tank chamber and a membrane position switch is coupled to the membrane. These switches control the state of the source of pressurized water to elevate the water pressure to above the gas pressure for recharging of the tank with water.

In a fifth separate aspect of the present invention, a non-carbonated water source for a beverage dispenser includes a tank with an access port, a source of pressurized carbonating gas in communication with the tank and a booster chamber extending into the tank. The booster chamber includes an inlet, a flexible membrane and a closure element and is capable of insertion and withdrawal from the tank through the access port.

In a sixth separate aspect of the present invention, a non-carbonated water source for a beverage dispenser includes a tank, a source of pressurized carbonating gas in communication with the tank, a valve assembly controlling supply to the tank and a booster chamber in the tank, defined by a membrane. The valve assembly is operatively coupled with the membrane to control communication through the valve assembly.

In a seventh separate aspect of the present invention, a water booster includes a tank with an access port, pressurized gas in the tank and a booster chamber including an inlet, a flexible membrane and a closure element. The flexible membrane is in the tank with one side of the flexible membrane being sealed from the pressurized gas and being in communication with the closure element. The booster chamber has a first configuration allowing insertion and withdrawal from the tank through the access port.

In an eighth separate aspect of the present invention, a water booster includes a tank, pressurized gas in the tank and a booster chamber including an inlet and a flexible membrane. The flexible membrane is in the tank with one side of the flexible membrane being sealed from the pressurized gas and being in communication with the inlet. A valve assembly controls flow to the inlet and is operatively coupled with the membrane so that membrane position controls communication through the valve assembly. A membrane location switch may also be employed to activate a source of pressurized water to elevate the water pressure to above that of the gas in the tank.

In a ninth separate aspect of the present invention, any of the foregoing aspects are contemplated to be combined.

Thus, an object of the present invention is to provide an improved water pressure booster. Other objects and advantages will appear hereinafter.

DETAILED DESCRIPTION OF THE PREFERRED EMBODIMENT

This disclosure is a companion of the disclosure in U.S. Pat. No. 5,855,296, the disclosure of which is incorporated herein by reference.

Figure 1:
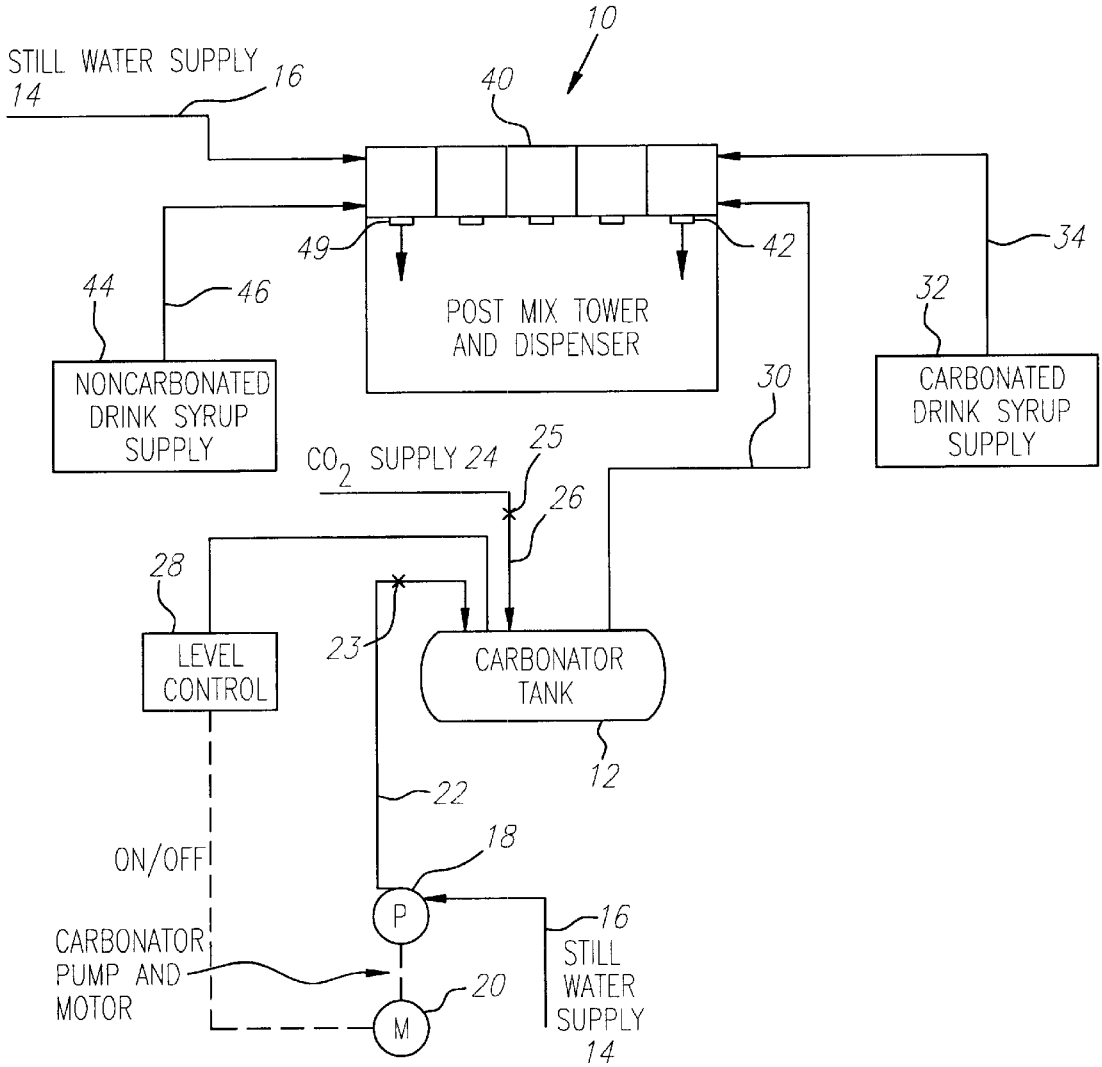
FIG. 1 (PRIOR ART)
FIG. 1 is a partly diagrammatic, partly schematic view of a carbonation and post-mix beverage dispensing system of the prior art.
Figure 2:
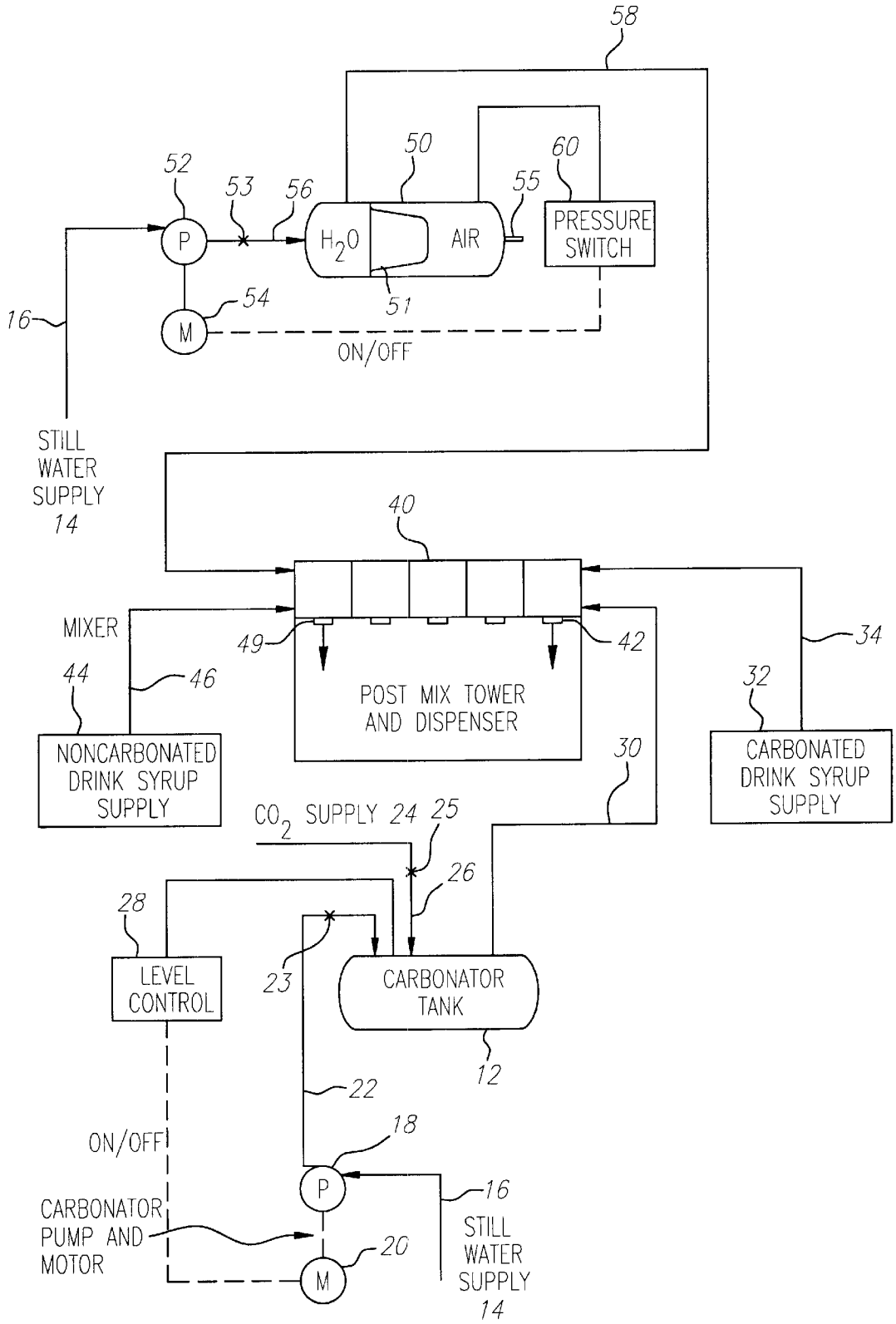
FIG. 2 (PRIOR ART)
FIG. 2 is a partly diagrammatic, partly schematic view of a carbonation and post-mix beverage dispensing system of the prior art in which non-carbonated water for preparation of non-carbonated beverages is maintained at an elevated pressure in a separate holding tank.
Figure 3:
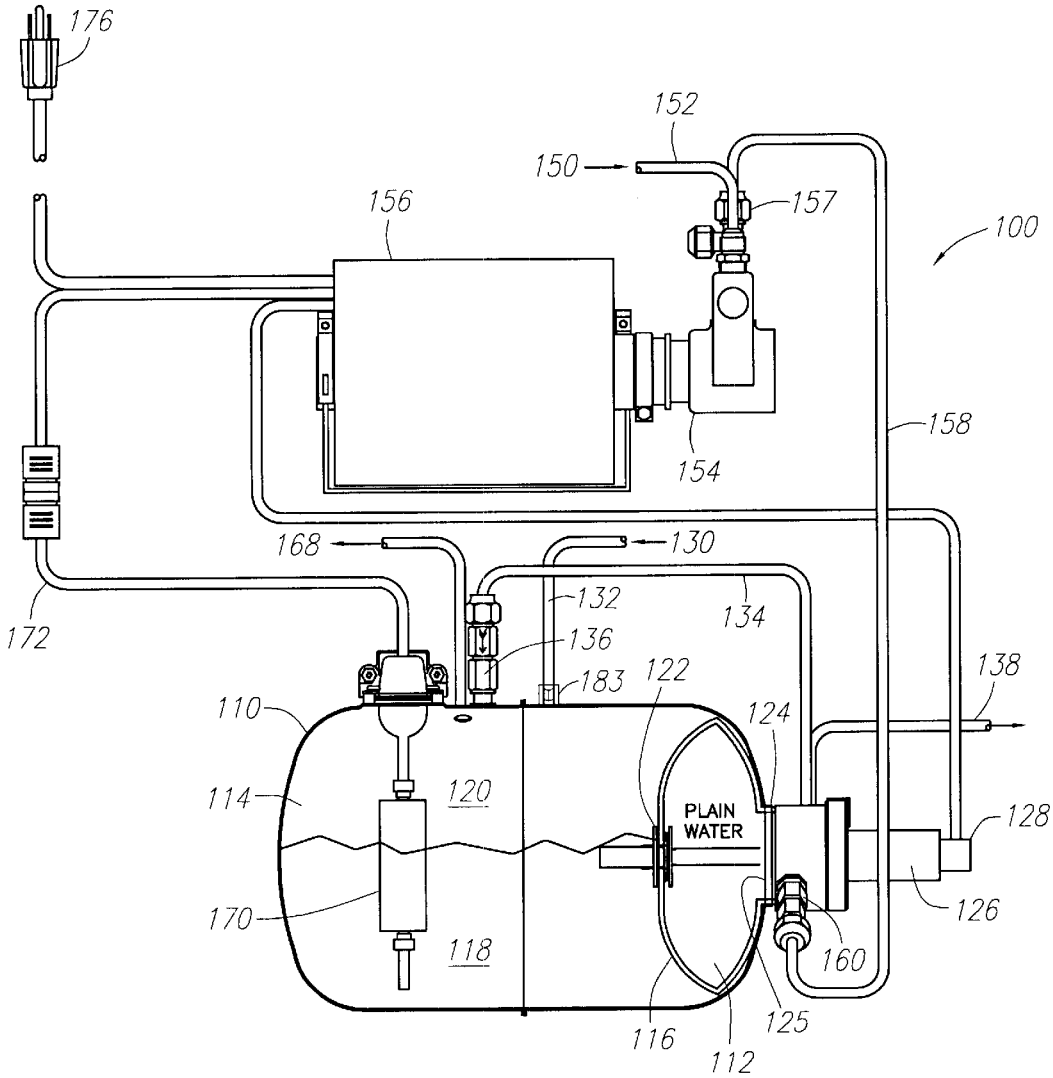
FIG. 3 schematically depicts a side elevational view of a single-tank combined carbonater and non-carbonated water booster tank.
Figure 4:
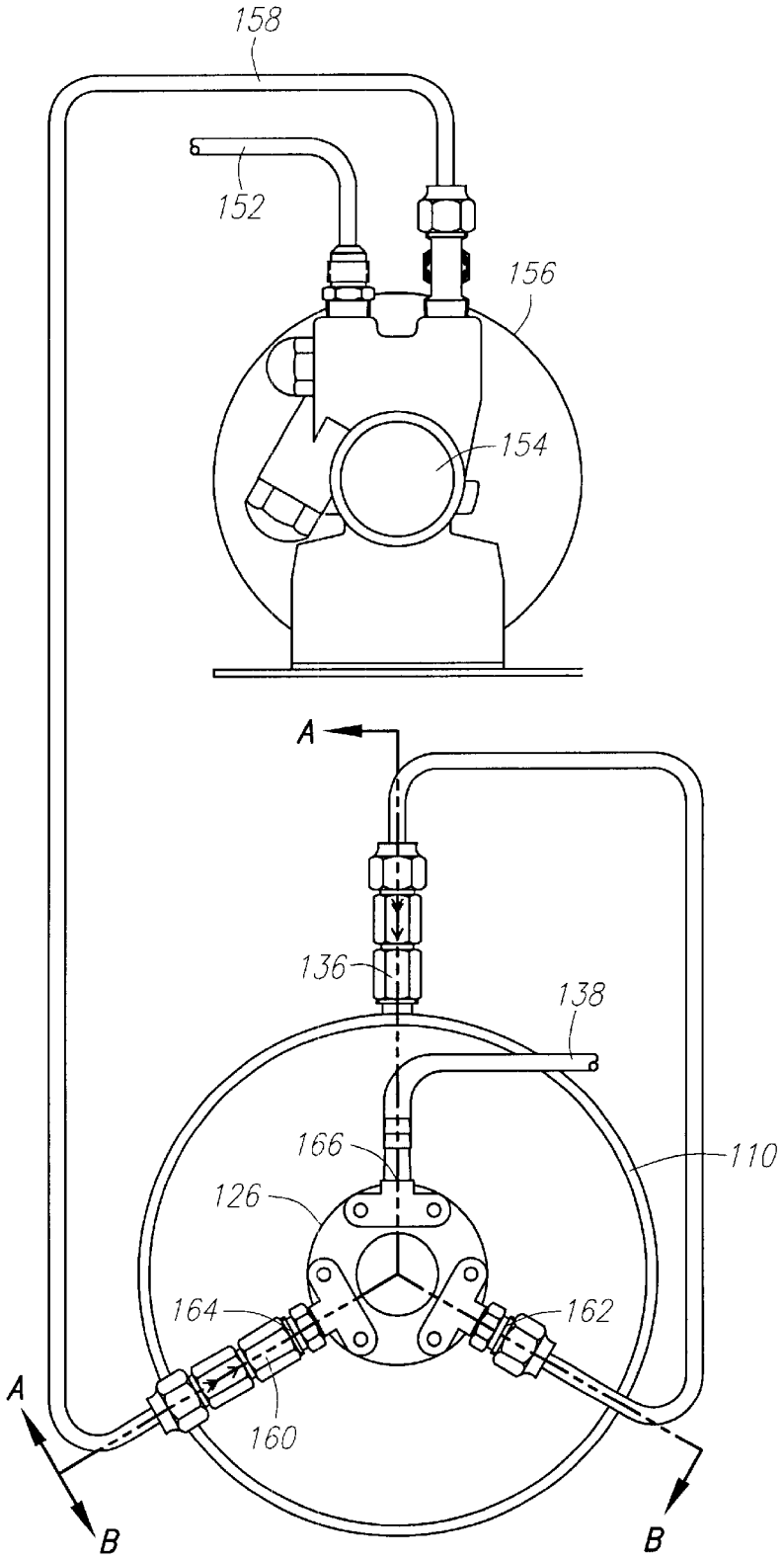
FIG. 4 schematically depicts an end elevational view of the embodiment of FIG. 3.

As shown in FIGS. 3 and 4, a carbonated and non-carbonated water source includes a combined carbonator and pressurized non-carbonated water tank 110 defining a tank chamber that is internally divided into a carbonated water chamber 114 and a non-carbonated water chamber 112 by a flexible membrane 116. The tank 110 may be made of any material that is not reactive with carbonated water, such as stainless steel, and the membrane 116 may be a bladder made of latex or other suitable polymer.

In use, the chamber 114 contains a body of carbonated water 118 and a "head" of $CO_2$ gas 120, while the chamber 112 contains a body of non-carbonated water at a pressure equal to the pressure of the $CO_2$ gas head 120. The carbonated and non-carbonated dispensing nozzles of an associated post-mix beverage dispensing assembly (not shown) are thus supplied by a carbonated water outlet line 168 which attaches to an open outlet in the carbonated water side of the tank 110, and by a non-carbonated water outlet line 138 which attaches to an open outlet on a valve assembly 126 communicating with the water chamber 112. The membrane 116 may be designed and placed such that, for example, a minimum of 75% of the tank 110 is always available for the carbonated water chamber 114, and the remaining 25% is available for the non-carbonated water chamber 112.

The flexible membrane 116 is part of a subassembly booster chamber defining the non-carbonated water chamber 112. The booster chamber includes the flexible membrane 116, a closure element 127, an inlet which is an outlet 180 from the valve assembly 126 and an outlet to a passageway 184. The flexible membrane 116 may find closure at the opening of the tank 110 in a number of ways. An access port may include a collar 125 welded or otherwise affixed in a sealing manner to the end of the tank 110. An annular socket on the collar 125 receives a bead 124 on the membrane 116. The closure element 127 mates with the collar 125 where it is secured by bolts 131 and compresses the bead 124. Thus, the closure element 127 circumferentially engages and tightly seals the open end 125 of the tank 110, and, as in the embodiment shown in FIG. 3, also simultaneously engages and seals the bead 124 of the membrane 116.

The closure element includes a bore 192 therethrough which forms part of the valve assembly 126. The valve assembly 126 may be a bidirectional valve and directs water to one or the other of the carbonated water chamber 114 and the non-carbonated water chamber 112. A source of pressurized water, for example, a pump 154 driven by a motor 156, pumps water under pressure through a double ball valve 157 and a water line 158 and into the valve assembly 126 where it is directed to either the carbonated water chamber 114 (through water line 134) or the non-carbonated water chamber 112 (through passageway 184, shown in FIG. 5). The pump 154 and motor 156 do not continuously operate in this embodiment. The source of pressurized water may be in a first state with the motor powered. In this state, the water 156 pressure is above the pressure of the carbonating gas so that water may flow into the chambers 112 and 114 faster than it is being depleted. In the inactive state with the motor 156 off, check valves prevent backflow.

A high pressure carbonating gas source 130 forces gas such as $CO_2$ into chamber 114 through a gas inlet line 132 and a check valve 183. A level sensor switch 170 (such as the liquid level sensing apparatus disclosed in McCann, U.S. Pat. No. 4,631,375, particularly adapted for use in vessels or tanks containing a fluid of the type utilized in liquid vending machines) activates the motor 156 when the level of carbonated water 118 drops to a predetermined lower limit, and turns it off when the level reaches a predetermined upper limit.

As seen in FIGS. 3–6, the valve assembly 126 has a water inlet 164 which can receive non-carbonated water at elevated pressures through a check valve 160 and the water line 158, which is fed by the pump 154. The chamber selector valve assembly 126 has an annular water outlet 180 that can selectively communicate water at elevated pressures from the inlet 164 (from the line 158, if the pump 154 is pumping) into the non-carbonated water chamber 112. The valve assembly 126 also has a water outlet 162 that can selectively communicate water at elevated pressure from the inlet 164 (from the line 158, if the pump 154 is pumping) into the carbonated water chamber 114 through the line 134 and the check valve 136. Finally, the valve assembly 126 has a non-carbonated water outlet 166 which is always open, allowing non-carbonated water in the chamber 112 to flow through the passageway 184 and into the water line 138, as it is drawn off at the non-carbonated beverage faucets of the dispenser assembly (not shown).

The valve assembly 126 is configured such that it provides pressurized non-carbonated water from the pump 154 to one or the other of the chambers 114 and 112 of the tank 110. As in the preferred embodiment shown in FIGS. 5 & 6, this may be accomplished by means of a spool valve 190 axially disposed within the bore 192 of valve assembly 126. It would also be possible to employ a solenoid valve in certain applications. An attachment bushing 122 at the distant end of the spool valve 190 firmly engages and anchors the center of the membrane 116 at the far end thereof (in the embodiment shown, a firm and sealing attachment is made through an orifice provided in the membrane 116).

Figure 5:
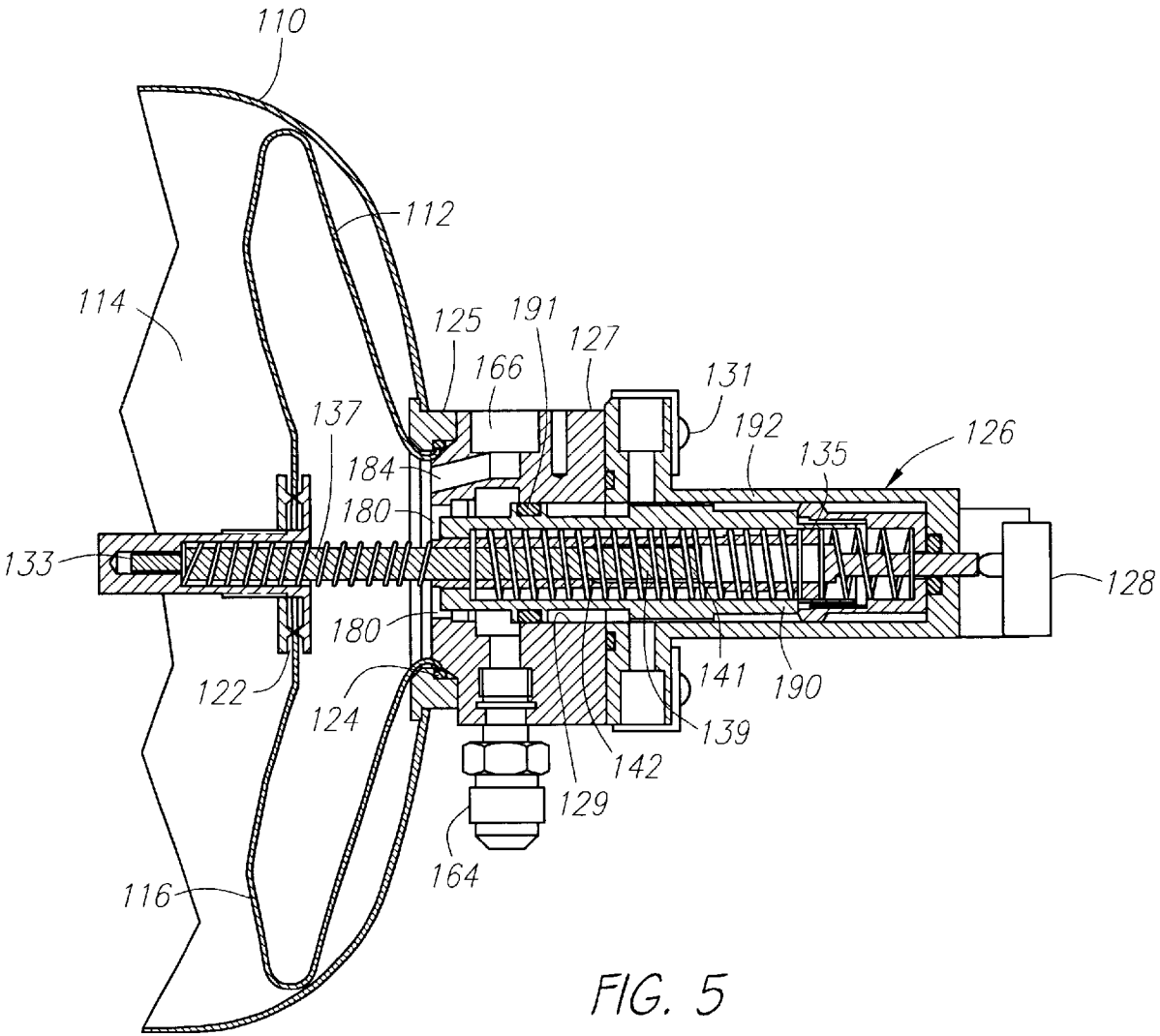
FIG. 5 is a partial side sectional view of the embodiment of FIGS. 3 & 4, taken along the lines A—A (shown in FIG. 4), showing the pressurized non-carbonated water chamber fully compressed, and showing the corresponding conditions in the directional chamber selector valve that is mounted onto the tank.
Figure 6:
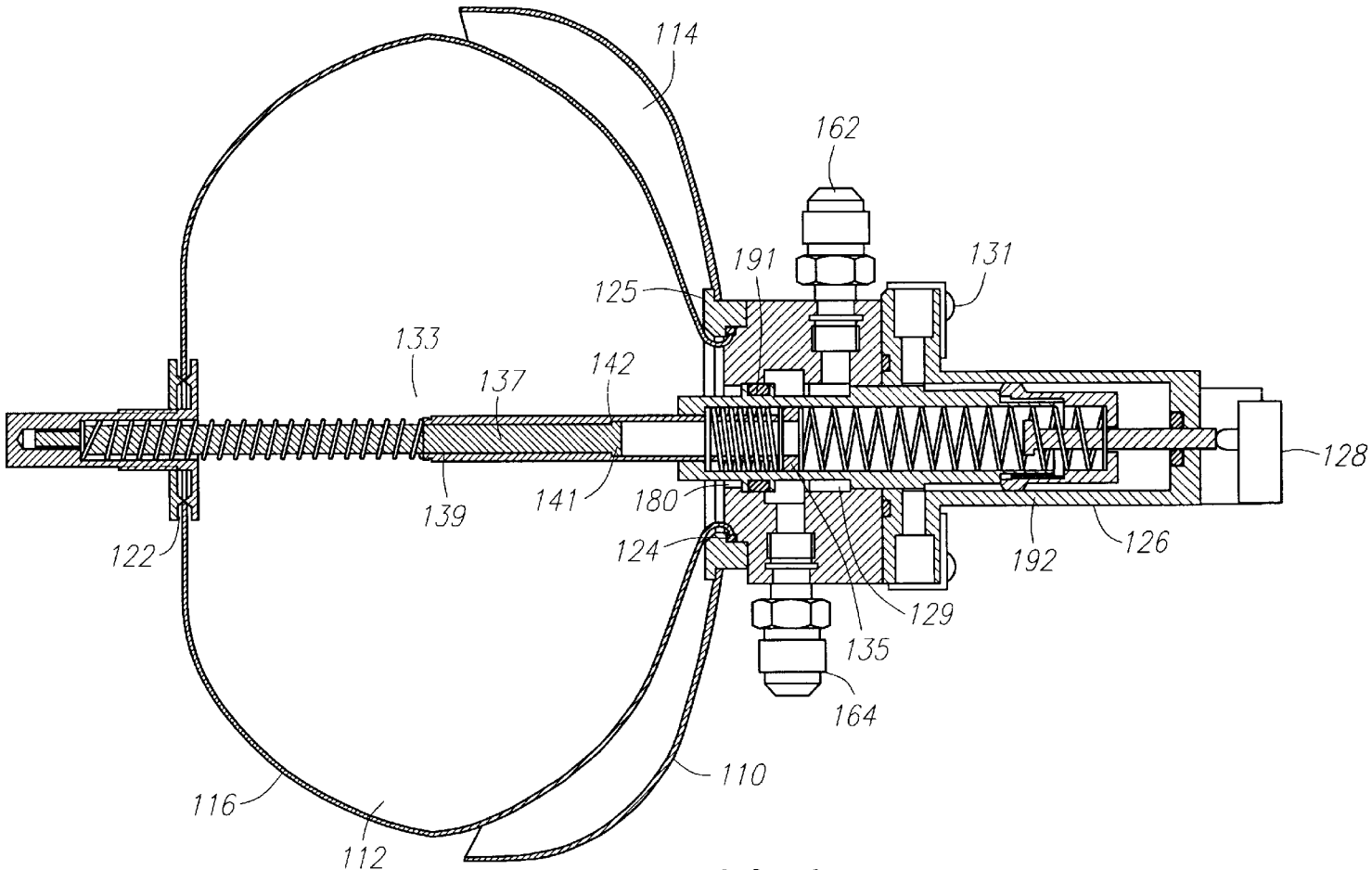
FIG. 6 is a partial side sectional view similar to FIG. 5, but taken along the lines B—B, and showing the non-carbonated water chamber fully expanded, and showing the corresponding conditions of the chamber selector valve.

FIGS. 5 & 6 illustrate how, at any given point, the spool valve 190 may block one or the other of the water inlets 162 or 180 with the land 191 in either a first or second position. Thus, when the membrane 116 is fully extended, as in FIG. 6, the spool valve 190 preferably blocks the water outlet 180, preventing communication of water into the non-carbonated water chamber 112. On the other hand, as in FIG. 5, when the membrane 116 is sufficiently compressed and contracted within the tank 110, the water outlet 162 is prevented from communicating with the carbonated water chamber 114.

The spool valve 190 is shown to be a multi-part configuration extending from the operative valve configuration to the attachment bushing 122. A tie bar 133 extends from the interior of the valve element 190 and includes springs to either side of a spring retainer 135 to cushion movement of the tie bar 133 relative to the valve element 190. The tie bar 133 includes an inner shaft 137 and an outer shaft 139 telescoped together. A lip 141 interferes with a restraint 142 to prevent full extraction of the inner shaft 137. The combination of the inner shaft 137 sliding within the outer shaft 139 and the tie bar 133 itself sliding within the valve element 190 creates a loss motion device to allow substantial motion of the flexible membrane 116 to control a much smaller travel associated with the valve element 190.

To begin operation, the tank chamber (which is initially empty) is connected via the line 132 and the check valve 183 to the carbonating gas source 130, and also to the line 134 via the check valve 136. The pump 154 and the motor 156 may then be connected to the water supply 150 via the line 152 and to a power source 176. $CO_2$ is then allowed into the carbonated water chamber 114 and attains a desired pressure, typically 100–150 psi. This high pressure causes the membrane 116 to become fully compressed in a contracted position within the tank 110. The motor 156 is activated causing the pump 154 to direct water through the line 158, the check valve 160, and into the inlet 164 of the valve assembly 126.

Because the membrane 116 is fully compressed, the land 191 of the spool valve 190 of the chamber selector valve assembly 126 obstructs the outlet 162, preventing the flow of pressurized water from the line 158 into the carbonation chamber 114. Instead, the spool valve 190 directs water from the line 158 through the annular outlet 180 and into the non-carbonated chamber 112. Then, as seen in FIG. 6, as the chamber 112 expands, the spool valve 190 blocks the outlet 180, preventing further introduction of water into the chamber 112. At the same time, the spool valve 190 no longer obstructs the outlet 162, allowing pressurized water from the line 158 to enter the carbonation chamber 114 where it absorbs $CO_2$ from the existing pressurized carbonating gas head 120, creating carbonated water 118. Water may flow into the carbonation chamber 114 until the level of carbonated water 118 reaches a predetermined maximum point at which the level sensor 170 shuts off the motor 156 (and thus the pump 154) via the electrical line 172.

If only carbonated drinks are drawn from the associated beverage dispenser (not shown), the non-carbonated chamber 112 is not utilized, and the lip 141 remains extended close to or pressed against the restraint 142. If non-carbonated drinks are drawn off, water is forced out of the non-carbonated water chamber 112 at substantially the same pressure as in the carbonated water chamber 114, because the pressure is transmitted by the membrane 116. The water level in the carbonated water chamber 114 then lowers as the membrane 116 contracts and the chamber 112 reduces in size.

If the volume of the chamber 112 is reduced sufficiently, the consequent reduction in the level of carbonated water 118 in the chamber 114 will cause the liquid level control 170 to signal the motor 156 to operate the pump 154 and direct water to the valve assembly 126. The valve assembly 126, in turn, directs water flow into the chamber 112 until the expansion of the chamber 112 raises the level of the carbonated water 118 in the chamber 114 sufficiently, or until the lip 141 reaches the restraint 142 (after which any further incoming water is directed by the valve assembly 126 into the carbonated chamber 114 as needed). In either case, the liquid level probe 170 turns off the motor 156 when the level of the carbonated water 118 reaches its maximum design limit. The lip 141 and the restraint 142 comprise a supplementary feature that can prevent over-expansion of the non-carbonated chamber 112.

Conversely, as a separate back-up feature to prevent the chamber 112 from contracting too far, the chamber selector valve assembly 126 may also incorporate a membrane position switch 128 that becomes mechanically actuated when the non-carbonated water chamber 112 is almost empty and the membrane 116 is in a contracted rather than an extended position, activating the motor 156 (irrespective of the state of the liquid level probe 170) via the line 174, causing the pump 154 to direct water to the valve assembly 126, through the annular outlet 180 and into the chamber 112. It should be noted that, depending on the configuration, the auxiliary switch 128 may not come into use frequently, because drawing off from the non-carbonated chamber 112 will also cause the level in the carbonated chamber 114 to drop, and depending on the settings, this may ordinarily be enough to activate the pump 154.

Easy replacement of the membrane 116 can be allowed for by making the tank access port 125 sufficiently large to extract and insert the desired bladder therethrough. The membrane 116, being flexible, may assume a configuration in the relaxed state to fit through the access port 125.

It is thus seen that a combined carbonator and water pressure booster can eliminate the need for much of the apparatus that is required by prior art devices providing both carbonated water and non-carbonated water to conventional post-mix beverage dispensers. Accordingly, the manufacturing, installation and servicing costs, and the space requirements may be reduced substantially. At the same time, a better controlled non-carbonated water pressure which is balanced with the pressure of the carbonated water can be achieved. In addition to improving the reliability of mixing proportions under all conditions, this is a particularly desirable feature in making lower carbonated drinks which require mixing both plain water and carbonated water with syrup. Further, the device disclosed herein can also be constructed so as to allow easy replacement of the parts most likely to fail, and it can be made as a unitary apparatus, or as one that attaches to existing equipment with little modification thereto.

Figure 7:
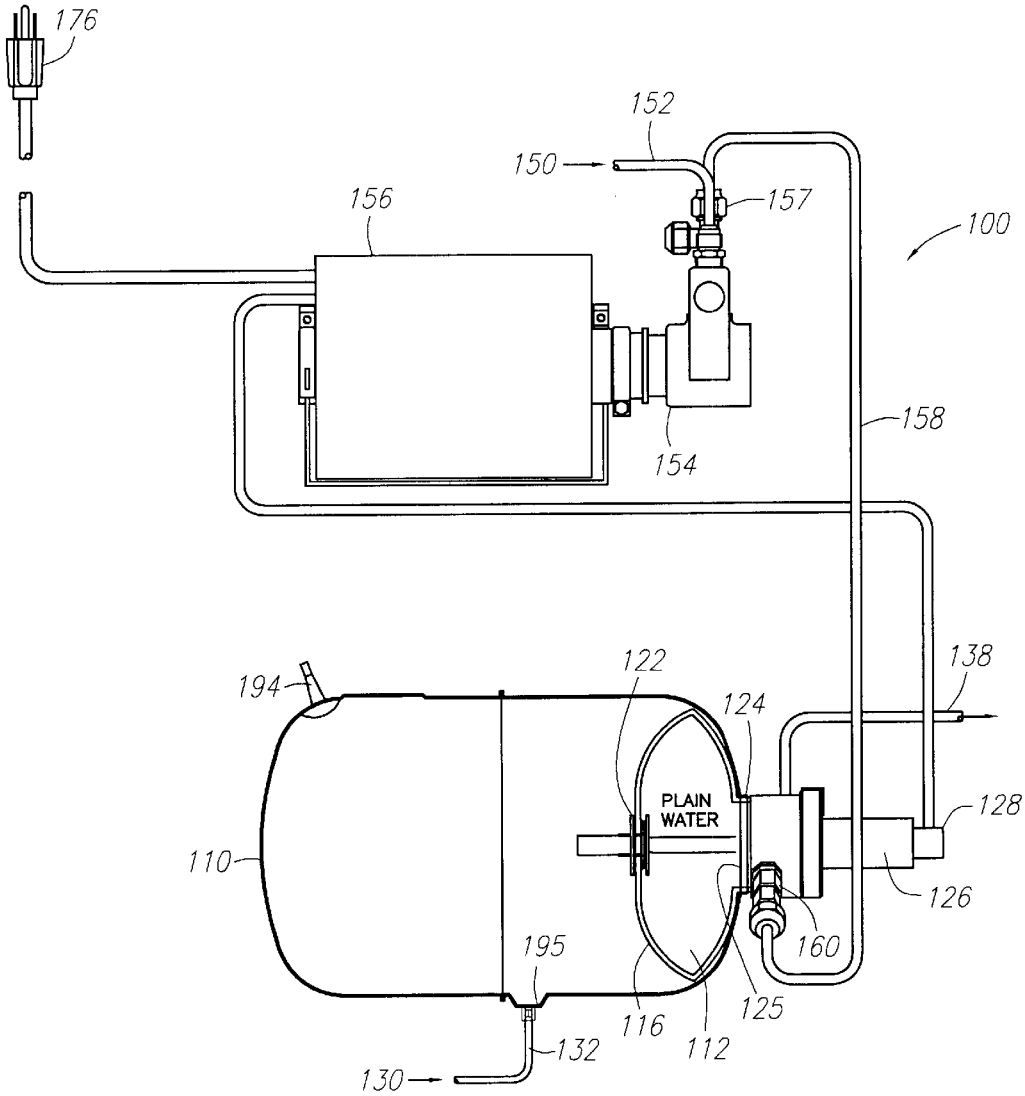
FIG. 7 schematically depicts a side elevational view of a water pressure booster.

FIG. 7 illustrates a water pressure booster which is not integrally formed with a carbonator tank. In this configuration, the tank 110 would not need a dedicated liquid inlet or a dedicated liquid outlet for water subject to carbonation. Pressure may be provided by either a static charge or a continuous supply. FIG. 7 illustrates both methods. A tire valve stem 194 might be employed to initially charge the interior of the tank 110 with pressurized gas. Under such a static charge, a two or four gallon tank is advantageous as the larger volume of compressed air will vary less in pressure with variation in the size of the water chamber 112 where the water chamber 112 is a smaller percentage of the total tank volume.

Alternatively, a source of pressurized gas 130 may extend to the tank 110 as also shown in FIG. 7 to provide pressurized gas in the tank 110. A separate source of pressurized gas 130 may provide uniform pressure between multiple tanks. The source of pressurized gas 130 may feed a carbonator tank or draw from a carbonator tank. In this instance, the booster tank would match the pressure in a carbonator tank to provide a similar rate of supply to a beverage dispensing machine or the like. A source of pressurized gas 130 provides a more constant level of pressure gas in the tank 110 unaffected by the position of the membrane 116. The inlet to the tank 110 of the source of pressurized gas 130 may be located at the bottom of the tank 110 in a recess 195. This placement allows for the displacement of any water, including condensate, back through the line to the source of pressurized gas 130 if that source is a carbonator and the flow path is not too long and/or downwardly from the tank 110. The check valve 183 would not be employed in such an application. The valve assembly 126 can also be simplified through the elimination of the outlet 162. The outlet 162 may otherwise simply be closed off.

Thus, an improved carbonator and non-carbonated water pressure booster are disclosed. It is clear from the foregoing disclosure that while particular forms of the invention have been illustrated and described, various modifications may be made without departing from the spirit and scope of the invention. Accordingly, it is not intended that the invention be limited to the foregoing disclosure except as by the appended claims.

What is claimed is:

1. A water source for a beverage dispenser, comprising:

a tank defining a first chamber and an access port, the first chamber including a first inlet;

a second chamber in the tank and including a second inlet, a flexible membrane and a closure element, the flexible membrane sealing the second chamber from the first inlet, the second chamber being in communication with the second inlet through the access port, the closure element being positionable in sealing engagement with the access port, the second chamber having a first configuration allowing insertion and withdrawal from the tank through the access port;

a source of pressurized carbonating gas in communication with the first inlet.

2. The water source of claim 1, the second chamber further including an outlet extending through the closure element, the closure element being removable from the tank with the second chamber, including the second inlet and the outlet.

3. The water source of claim 1 further comprising a source of pressurized water;

a valve assembly in communication with the second inlet and the source of pressurized water.

4. The water source of claim 3, the valve assembly including a first position with no communication between the source of pressurized water and the second inlet and a second position with communication between the source of pressurized water and the second inlet.

5. A water source for a beverage dispenser, comprising:

a tank defining a first chamber and an access port, the first chamber includes a first inlet;

a second chamber in the tank and including a second inlet, a flexible membrane and a closure element, the flexible membrane sealing the second chamber from the first inlet, the second chamber being in communication with the second inlet through the access port, the closure element being positionable in sealing engagement with the access port, the second chamber having a first configuration allowing insertion and withdrawl from the tank through the access port;

a source of pressurized carbonating gas in communication with the first inlet;

a source of pressurized water;

a valve assembly in communication with the second inlet and the source of pressurized water, the valve assembly including a first position with no communication between the source of pressurized water and the second inlet and a second position with communication between the source of pressurized water and the second inlet, the valve assembly being operatively coupled with the membrane, one of the first and second positions being with the membrane extended into the tank and the other of first and second positions being with the membrane contracted within the tank.

6. The water source of claim 5, the valve assembly including a bore and a valve in the bore, the source of pressurized water including an inlet port to the bore, the second inlet being in communication with the bore.

7. A water source for a beverage dispenser, comprising:

a tank defining a first chamber and an access port, the first chamber including a first inlet;

a second chamber in the tank and including a second inlet, a flexible membrane and a closure element, the flexible membrane sealing the second chamber from the first inlet, the second chamber being in communication with the second inlet through the access port, the closure element being positionable in sealing engagement with the access port, the second chamber having a first configuration allowing insertion and withdrawal from the tank through the access port;

a source of pressurized carbonating gas in communication with the first inlet;

a source of pressurized water;

a valve assembly in communication with the second inlet and the source of pressurized water, the valve assembly including a first position with no communication between the source of pressurized water and the second inlet and a second position with communication between the source of pressurized water and the second inlet, the valve assmebly being operatively coupled with the membrane, one of the first and second positions being with the membrane extended into the tank and the other of first and second positions being with the membrane contracted within the tank, the valve assembly including a bore and a valve in the bore, the source of pressurized water including an inlet port to the bore, the second inlet being in communication with the bore;

a membrane position switch having a membrane extended position and a membrane contracted position, the source of pressurized water including a first state with the water pressure above the gas pressure of the source of pressurized gas when the membrane position switch is in the membrane contracted position, the second inlet being in communication with the bore between the membrane and the inlet port.

8. The water source of claim 7, the other end of the valve being rigidly coupled to the center of the membrane.

9. The water source of claim 3, the source of pressurized water including a pump and a motor coupled with the shaft of the pump.

10. The water source of claim 1, the membrane being a bladder having a circular opening sealed with the closure.

* * * * *